US009132452B2

(12) United States Patent
Trivette et al.

(10) Patent No.: US 9,132,452 B2
(45) Date of Patent: Sep. 15, 2015

(54) MINING CLASSIFIER ASSEMBLY

(71) Applicants: Roger Blaine Trivette, Inman, SC (US); Todd Martin, Inman, SC (US)

(72) Inventors: Roger Blaine Trivette, Inman, SC (US); Todd Martin, Inman, SC (US)

( * ) Notice: Subject to any disclaimer, the term of this patent is extended or adjusted under 35 U.S.C. 154(b) by 184 days.

(21) Appl. No.: 13/888,421

(22) Filed: May 7, 2013

(65) Prior Publication Data

US 2014/0332448 A1 Nov. 13, 2014

(51) Int. Cl.

| | |
|---|---|
| ***B03B 7/00*** | (2006.01) |
| ***B07B 1/46*** | (2006.01) |
| ***B03B 5/02*** | (2006.01) |

(52) U.S. Cl.

CPC .... *B07B 1/46* (2013.01); *B03B 5/02* (2013.01)

(58) Field of Classification Search

CPC .. B07B 1/4069; B07B 2201/02; B07B 1/4681
USPC ..... 209/17, 44, 313, 353, 417
See application file for complete search history.

(56) References Cited

U.S. PATENT DOCUMENTS

| | | | | |
|---|---|---|---|---|
| 2,020,013 | A * | 11/1935 | Bailey | 209/311 |
| 2,074,733 | A * | 3/1937 | Porter | 209/330 |
| 5,190,158 | A * | 3/1993 | Remias | 209/44 |
| 5,423,430 | A * | 6/1995 | Zaffiro et al. | 209/315 |

* cited by examiner

*Primary Examiner* — Terrell Matthews
(74) *Attorney, Agent, or Firm* — Thomas L. Moses; Southeast IP Group, LLC

(57) ABSTRACT

A mining classifier assembly includes a round main body member with a flat bottom portion, preferably adapted to be received into the top portion of a round bucket or similar container, including a series of holes in the bottom portion thereof. The main body member may be placed into the top of a bucket that contains water. A load of dirt, containing rocks, minerals, gemstones, and the like, may be loaded into the main body member so that the water at least partially covers the load, and an operator may agitate the particulate within the water, so that the particulate small enough to fall through the holes in the main body member may fall through, while the larger particulate remains within the main body member. Additionally, a series of trays having a mesh bottom may be inserted into the main body member, to catch and separate smaller particulate.

6 Claims, 4 Drawing Sheets

MINING CLASSIFIER ASSEMBLY

BACKGROUND OF THE INVENTION

The present invention relates generally to equipment generally used in panning and mining operations. More specifically, the present invention relates to classifiers, which are used to sift through dirt, rocks, and minerals that have been dug or dislodged from the ground, so that different sized chunks of material are separated from the rest. The classifier assembly includes a main body member, which is preferably adapted to be received into the top portion of a round bucket or similar container, and includes a series of holes in a bottom portion thereof. The main body member may be placed into the top portion of a bucket that contains water, so that the water level is positioned above the bottom of the main body member. A load of dirt, containing rocks, minerals, gemstones, and the like, may be loaded into the main body member so that the water at least partially covers the load, and an operator may agitate the particulate within the water, so that the particulate that is small enough to fall through the holes in the main body member may fall through, while the larger particulate remains within the main body member. Additionally, a series of trays having a mesh bottom may be inserted into the main body member, in order to catch smaller particulate. Each tray includes a screen or mesh having different sized openings therein, and the operator may select which tray he or she desires, based on the size of particulate that he or she is trying to capture or separate from the rest of the load.

Heretofore, many different devices have been developed and commercialized to separate different sized particulate and sediment in mining operations. For example, U.S. Pat. No. 4,289,241 discloses a gold panning and classifying method and system including a generally rectangularly shaped gold pan having diverging side panels and a plurality of valleys and ridges in the front panel. A plurality of nesting classifying screens are included to effect a first separation of material into portions composed of equivalent size particles. The unique shape of the pan employs gravity separation techniques for separating fine sands from gold and gold dust.

U.S. Pat. No. 4,319,994 is directed to a gold mining pan having riffle-like slits or grooves in the bottom and a device for separating the material contained in the slits or grooves from the remainder of a slurry contained within the pan. The pan may also include a device for removing the material contained within the slits from the pan.

U.S. Pat. No. 4,371,436 describes an apparatus for recovering silver from spent photographic solutions comprising a tray with a number of non-reactive filter elements having successively smaller porosity through which the spent solutions can be passed. Each successive filter element prevents silver particles of progressively smaller sizes suspended in the liquid from passing therethrough. The filters are stacked in a horizontal position within the tray and a tray cover sits on top of the tray, the cover having an opening into which the developing solutions can be poured. The tray includes a drainage port which allows liquid passing through the filters to drain out of the tray.

U.S. Pat. No. 4,472,269 is directed to a sluice box classifier for a sluice box of a gold mining dredge including a trough and a rim secured to an underside of the trough. The rim anchors the trough to a standard size container. The trough is formed of four walls and a bottom, and is at least as wide as a lower end portion of the sluice box from which collected overburden is received. The bottom includes a center panel and two floor panels which slope upwardly from opposite sides of the center panel to meet opposite sidewalls of the trough. The floor panels funnel overburden deposited into the trough from the sluice box to the center panel, where a plurality of openings in the center panel allows the smaller pieces of overburden to pass through into the container. A portion of a front wall of the trough is bent outwardly of the trough to cooperate with an angle member so as to form a slot which connects the trough to the sluice box.

U.S. Pat. No. 4,839,034 discloses an apparatus to separate heavier metal particles from lighter particles gangue in a fluidic medium by gravity and fluid flow. A vertical container provides a lower fluid input chamber that communicates through a medial structure providing a plate defining a plurality of valve ports, a screen, and a plate defining a plurality of holes to an upper chamber carrying particulate material to be beneficiated. Pressurized water flows upwardly through the medial structure to separate more dense metal bearing particles in the medial structure and gangue exits from a central orifice defined in the medial portion of the separating structure.

BRIEF SUMMARY OF THE INVENTION

In accordance with one aspect of the invention, a mining classifier assembly includes a round main body member with a flat bottom portion, which is preferably adapted to be received into the top portion of a round bucket or similar container, and includes a series of holes in the bottom portion thereof. The main body member may be placed into the top portion of a bucket that contains water, so that the water level is positioned above the bottom of the main body member. A load of dirt, containing rocks, minerals, gemstones, and the like, may be loaded into the main body member so that the water at least partially covers the load, and an operator may agitate the particulate within the water, so that the particulate that is small enough to fall through the holes in the main body member may fall through, while the larger particulate remains within the main body member. Additionally, a series of trays having a mesh bottom may be inserted into the main body member, in order to catch and separate smaller particulate. Each tray includes a screen or mesh having different sized openings therein, and the operator may select which tray he or she desires, based on the size of particulate that he or she is trying to capture or separate from the rest of the load. The trays are preferably made from a circular frame member, which includes an upper portion and a lower portion, with the mesh sandwiched therebetween. In a preferred embodiment, the lower portion of the circular frame member may have cross braces that form an X across the bottom of the mesh for support.

In use, an operator may insert the main body member into a bucket of water, and run a first batch of granular material through the main body member. This procedure will separate the largest particulate from the smaller particulate, so that the user may then sift through the larger particulate in search of gold nuggets, gemstones and the like. If desired, the user may then discard the remaining large particulate, and then insert a tray having screen with the largest holes into the main body member, and run the granular material back through the tray, screen, and main body member again, which is designed to catch and separate slightly smaller particulate. This procedure may be repeated, by using trays having screens with increasingly smaller holes, in order to capture even smaller particulate of approximately equal size in successive runs.

One advantage to this arrangement is that the main body member and trays may be at least partially submerged in water during the separation and capture process, so that small amounts of water may be used and reused in successive runs.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
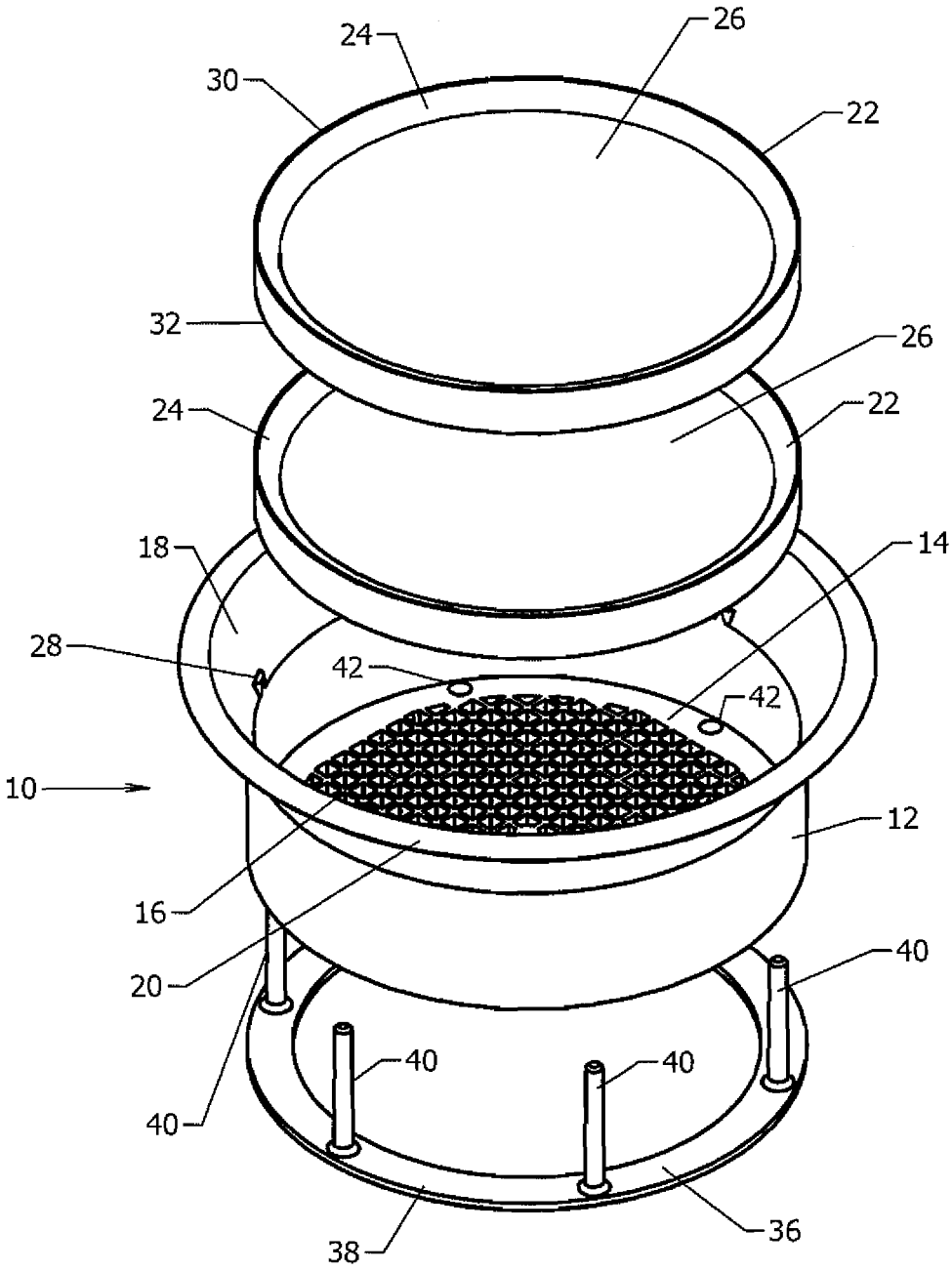
FIG. 1 is a perspective exploded view of a mining classifier assembly in accordance with one aspect of the present invention.
Figure 3:
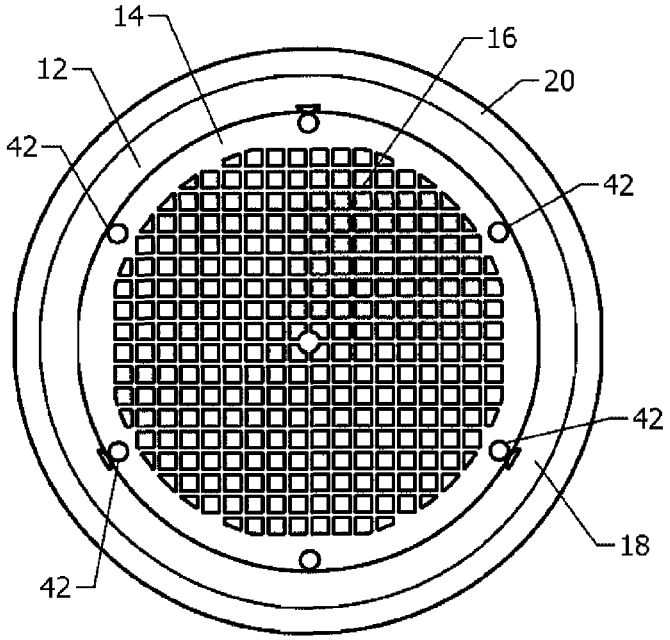
FIG. 3 is a top view of a main body member of a mining classifier assembly in accordance with one aspect of the present invention.
Figure 2:
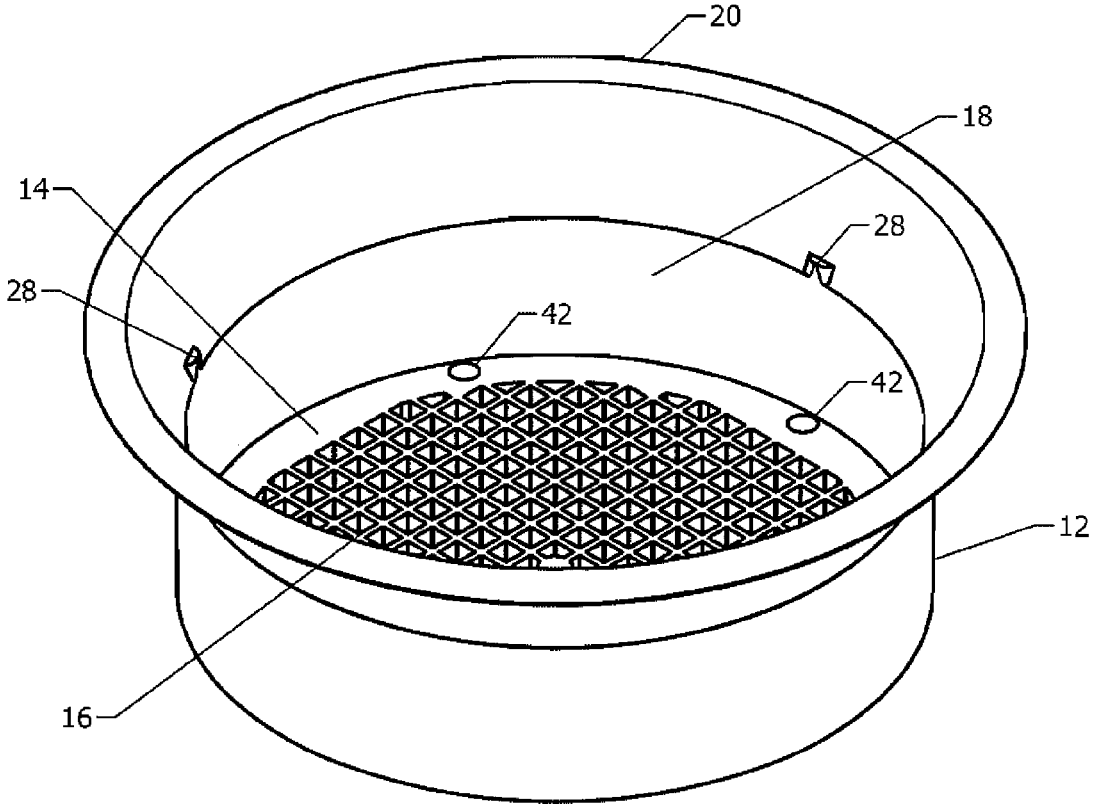
FIG. 2 is a perspective view of a main body member of a mining classifier assembly in accordance with one aspect of the present invention.
Figure 5:
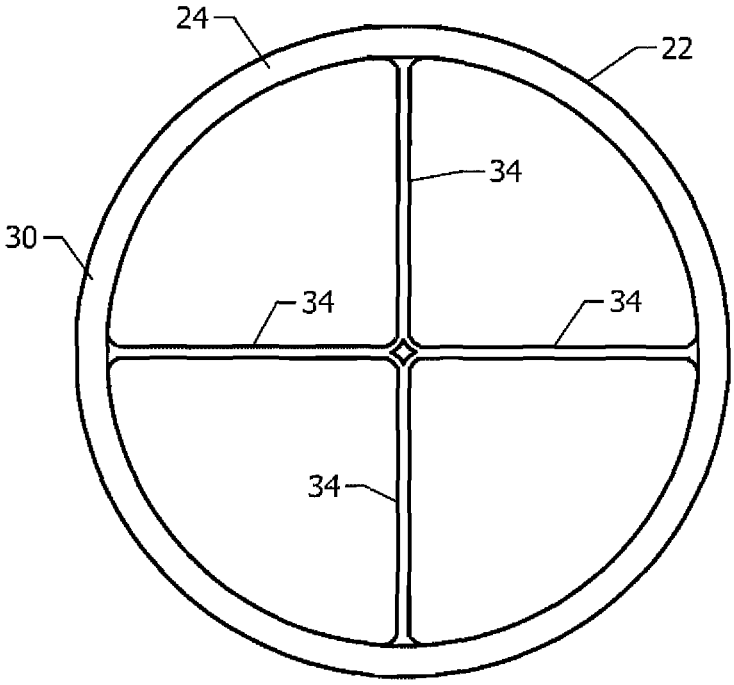
FIG. 5 is a top view of a tray frame of a mining classifier assembly in accordance with one aspect of the present invention.
Figure 4:
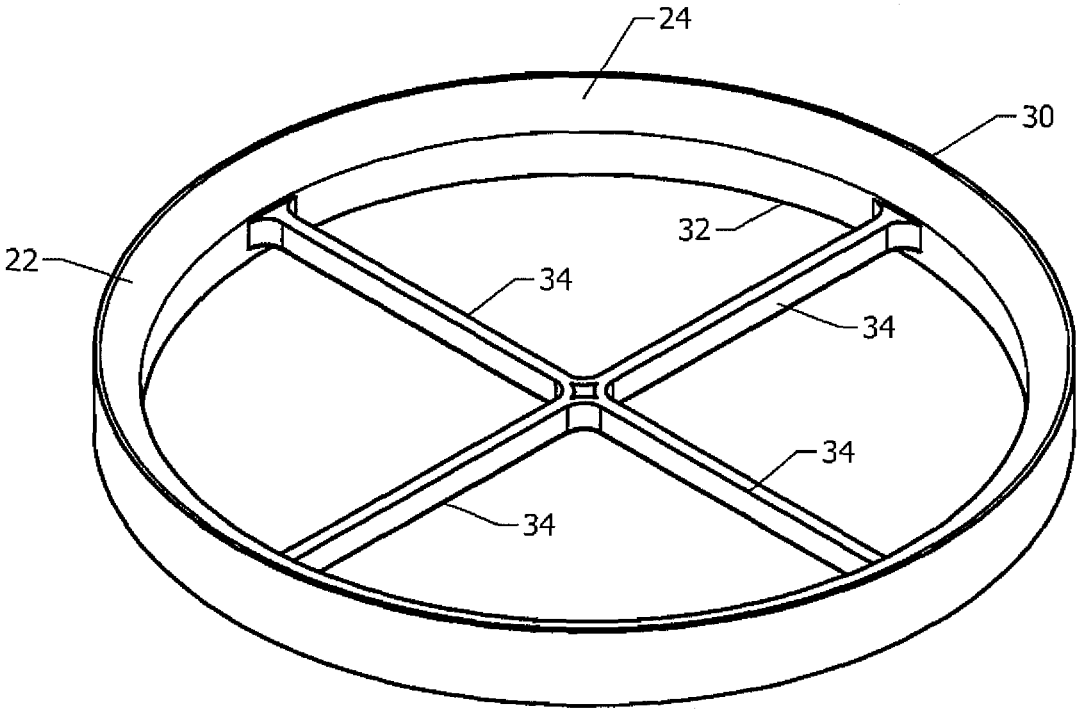
FIG. 4 is a perspective view of a tray frame of a mining classifier assembly in accordance with one aspect of the present invention.
Figure 7:
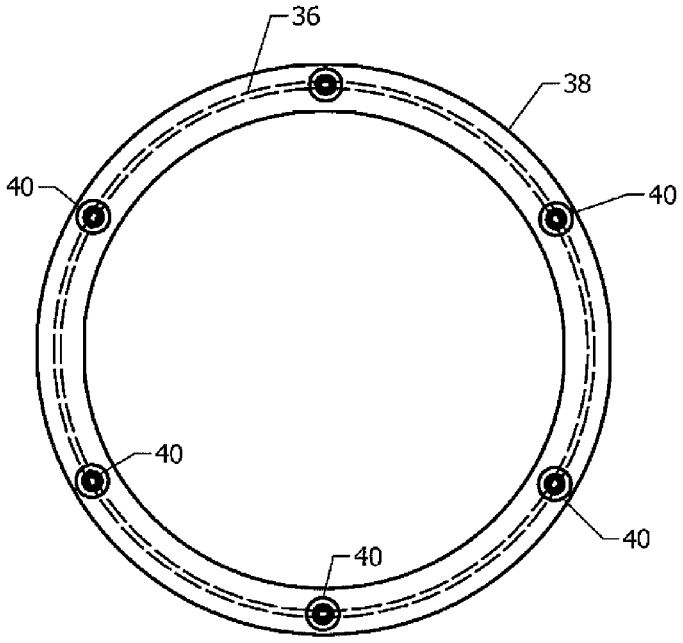
FIG. 7 is a top view of a tray removal tool of a mining classifier assembly in accordance with one aspect of the present invention.
Figure 6:
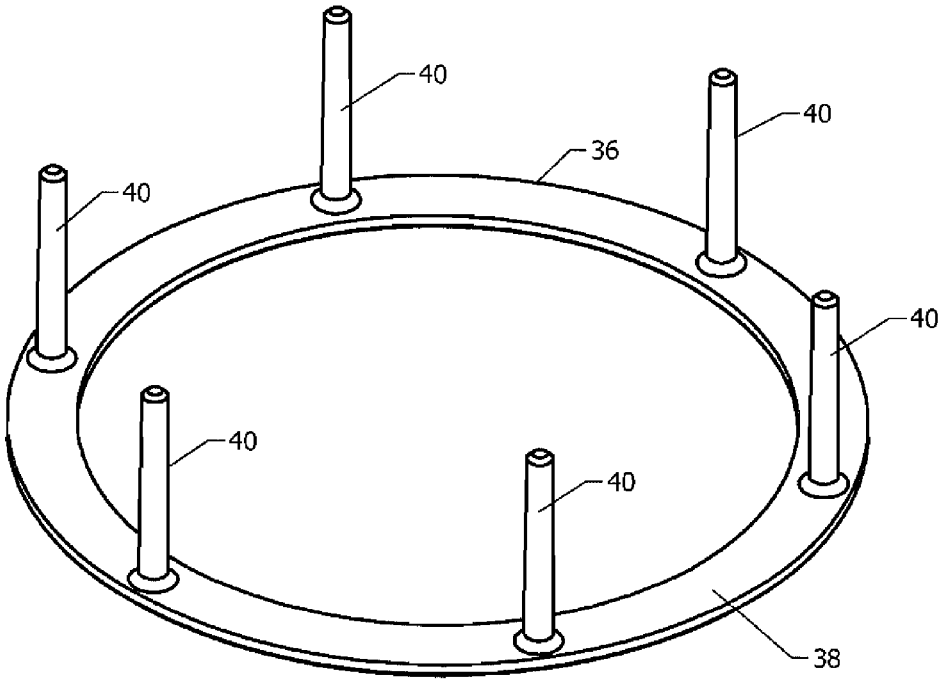
FIG. 6 is a perspective view of a tray removal tool of a mining classifier assembly in accordance with one aspect of the present invention.

The present invention includes a mining classifier assembly 10 used for capturing and separating particulate, and more specifically rocks, dirt, gemstones, minerals, and the like, so that particulate of similar size may be separated from the rest. Typically in a small mining operation, or where a person is panning for gold, the person has extracted a pile of dirt potentially containing rocks, minerals, gemstones, gold, silver, and the like. It is necessary to sift through this bulk of earth in order to extract particulate having some value, such as the gold, silver, gemstones, etc.

The mining classifier assembly 10 provided herein includes a main body member 12 which preferably has a circular shape with a flat bottom portion 14. A series of holes 16, each having a similar size, are disposed in the flat bottom 14 of the main body member 12. The main body member 12 further includes a side enclosure 18 (or side wall, or series of side walls, depending upon the shape) that extends upwardly from the perimeter of the flat bottom 14, and the upper periphery of the side enclosure 18 defines a mouth 20 of the main body member 12. The main body member 12 is adapted to be received in the mouth of a round bucket (not shown), although the main body member 12 may have any shape that conforms to the shape of a bucket or desired container. The bucket or container may contain water, and the water level may be set within the bucket so that the flat bottom portion 14 of the main body member 12 is beneath the surface of the water level when the main body member 12 is positioned within the bucket.

Additionally, a series of trays 22 may be used in removable cooperation with the main body member 12. Each tray 22, in a preferred embodiment, includes a round frame 24 that holds a substantially flat section of screen or mesh 26, wherein the mesh 26 defines a series of holes through which small particulate may pass, but particulate that is larger than the holes is captured on top of the mesh 26. Each tray 22 may include mesh 26 of a different size, so that the mesh holes of one tray 22 are of a different size (larger or smaller) than the mesh holes of other trays 22. Each tray 22 is adapted to fit inside the main body member 12, so that the tray 22 sits in a horizontal orientation above the flat bottom 14 thereof. The main body member 12 may have a series of small lips 28 disposed about an inner perimeter thereof, which may be used to support the tray 22 when it is in position within the main body member 12. The trays 22 may be color coded, where each frame 24 has a different color, to distinguish each tray 22 (and hence the size of the mesh or screen holes) from the others.

The trays 22 are preferably made from a circular frame member 24, which includes an upper portion 30 and a lower portion 32, with the mesh 26 sandwiched therebetween. In a preferred embodiment, the lower portion 32 of the circular frame member 24 may have cross braces 34 that form an X across the bottom of the mesh 26 for support, although any support mechanism may be used, so long as it does not interfere with the operation of the tray 22. To form the trays 22, The screen or mesh 26 is inserted between the upper 30 and lower portions 32 of the frame 24, which is heated (preferably by hot-plate welding), and then the upper 30 and lower portions 32 are joined together while hot, so that the screen or mesh 26 is captured tightly between the upper 30 and lower portions 32. The frames 24 of the trays 22, as well as the main body member 12, are preferably made from any suitable plastic, while the mesh 26 may be made from any suitable material, including metal or plastic.

There are several ways that the trays 22 may be used. First, a user may start with a load of dirt (including rocks, gems, minerals, etc.), and place the dirt into the main body member 12 without a tray 22, while the main body member 12 is situated within a bucket full of water. The water level covers at least a portion of the dirt load, and the operator may agitate the dirt load within the water (with his hands, or by shaking, for example) until the smaller particulate falls through the holes 16 in the flat bottom 14 of the main body member 12. The user may then search through the larger particulate that remains in the main body member 12, extracting anything of value and discarding the rest. Then, the user may insert a tray 22 (preferably the tray 22 having the mesh 26 with the largest holes), and repeat the operation with the dirt and particulate that fell to the bottom of the bucket during the first phase of the operation. After removing the valuable particulate from the tray 22 with the largest mesh holes, the operator may repeat the operation with the tray 22 having the next largest holes (smaller than the previous tray 22), until ultimately, the particulate has been run through all trays 22, and the particulate has been separated and captured according to the size of the particulate.

Alternatively, it is contemplated that the trays 22 may be stacked, one on top of the other, within the main body member as shown in FIG. 1, with the tray 22 and mesh 26 with the largest holes on top, and the tray 22 and mesh 26 with the smallest holes on bottom, so that the particulate is simultaneously separated into particulate of similar size on each successive tray 22.

In one embodiment, a tray removal tool 36 is provided, in order to assist in removing a tray 22 or trays 22 from the main body member 12. The tray removal tool 36 preferably includes a circular frame 38 with a series or protruding fingers 40 disposed about the circular frame 38 in evenly spaced intervals an axial direction. In this embodiment, the fingers 40 correspond with finger holes 42 around the perimeter of the flat bottom 14 of the main body member 12, so that the tray removal tool 36 may be positioned below the main body member 12, wherein the fingers 40 are extending upwardly through the corresponding finger holes 42. As the tray removal tool 36 is pushed upwardly, the distal ends of the fingers 40 engage the bottom of the tray 22 (or lowest tray 22), and the fingers 40 push the tray 22 upwardly to the mouth 20 of the main body member 12 for easy removal therefrom. The tray removal tool 36 may then be removed from the finger holes 42. It is also contemplated that the tray removal tool 36 may be more permanently affixed to the main body member 12, wherein the tray removal tool 36 is in sliding relation to the main body member 12, and the distal ends of the fingers 40 have stops (similarly to the head of a nail—not shown), that prevent the fingers 40 from being removed from the corresponding finger holes 42. In that embodiment, during use of the main body member 12 and trays 22 within a bucket or the like, the tray removal tool 36 simply hangs below the main body member 12 until it is needed, and then the main body member 12 is removed from the bucket and the tray removal tool 36 is pushed upwardly to remove the tray 22 or trays 22 positioned therein.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A mining classifier assembly comprising:

a main body member having a generally flat bottom portion and an enclosure extending upwardly from said bottom portion, said enclosure having a mouth at an upper periphery of said enclosure;

said bottom portion defining a series of holes of similar size and shape therethrough;

said main body member adapted to be removably received in the mouth of a container that is capable of holding water;

a first tray having a shape that corresponds with a shape of said main body member, said tray including a frame member, and having a substantially flat mesh portion attached to an inner periphery of said frame member, wherein said mesh defines a series of holes;

wherein said first tray is adapted to be removably received within said main body member in a generally horizontal orientation;

including tray removal tool comprising a round frame member and a series of fingers evenly spaced about said round frame member, said fingers projecting axially away from said round frame member; and wherein said fingers correspond with a series of holes disposed about a periphery of said bottom portion of said main body member so that said tray removal tool may be positioned below said main body member and said fingers may pass through said corresponding holes in order to engage and apply pressure to a bottom portion of said first tray when said first tray is disposed within said main body member, so that said tray may be removed from said main body member.

2. The mining classifier assembly set forth in claim 1, wherein a series of horizontally disposed lips are positioned about an inner periphery of said enclosure for supporting said tray, when said first tray is positioned within said main body member.

3. The mining classifier assembly set forth in claim 1, further including a second tray, wherein said second tray has a shape that corresponds with a shape of said main body member, said second tray including a frame member, and having a substantially flat mesh portion attached to an inner periphery of said frame member, wherein said mesh of said second tray defines holes of a different size than the holes defined by the mesh of said first tray.

4. The mining classifier set forth in claim 3, wherein said frames of said first tray and said second tray are color coded in order to visually distinguish said first tray from said second tray.

5. The mining classifier set forth in claim 1, wherein said first tray frame comprises an upper portion and a lower portion, with said mesh sandwiched therebetween.

6. The mining classifier set forth in claim 5, wherein said lower portion of said first tray frame includes a cross-brace support.

* * * * *